US008500665B2

(12) United States Patent
Schulz et al.

(10) Patent No.: US 8,500,665 B2
(45) Date of Patent: Aug. 6, 2013

(54) INSTRUMENT FOR APPLYING VIBRATIONS TO THE HUMAN BODY

(75) Inventors: Manfred Schulz, Taegerwilen (CH); Pavel Novak, Stetten (CH)

(73) Assignee: Storz Medical AG (CH)

( * ) Notice: Subject to any disclaimer, the term of this patent is extended or adjusted under 35 U.S.C. 154(b) by 119 days.

(21) Appl. No.: 12/870,522

(22) Filed: Aug. 27, 2010

(65) Prior Publication Data

US 2011/0054367 A1 Mar. 3, 2011

Related U.S. Application Data

(63) Continuation-in-part of application No. 11/178,910, filed on Jul. 11, 2005, now abandoned.

(30) Foreign Application Priority Data

Jul. 9, 2004 (DE) ..... 20 2004 011 323 U

(51) Int. Cl.
*A61H 7/00* (2006.01)

(52) U.S. Cl.
USPC ..... 601/105; 601/46; 601/97; 604/2

(58) Field of Classification Search
USPC 601/108, 2, 57–59, 80, 46, 105, 97; 600/437, 600/407; 604/2
See application file for complete search history.

(56) References Cited

U.S. PATENT DOCUMENTS

| | | | | |
|---|---|---|---|---|
| 4,549,535 | A | 10/1985 | Wing | |
| 4,716,890 | A * | 1/1988 | Bichel | 601/108 |
| 5,018,894 | A * | 5/1991 | Goncalves | 401/202 |
| 5,020,535 | A | 6/1991 | Parker et al. | |
| 5,160,336 | A | 11/1992 | Favre | |
| 5,568,983 | A | 10/1996 | Wilson | |
| 5,639,238 | A | 6/1997 | Fishburne, Jr. | |
| 6,056,716 | A * | 5/2000 | D'Antonio et al. | 604/68 |
| 6,068,596 | A * | 5/2000 | Weth et al. | 600/437 |
| 6,228,042 | B1 | 5/2001 | Dungan | |
| 6,264,660 | B1 | 7/2001 | Schmidt et al. | |
| 6,318,243 | B1 * | 11/2001 | Jones | 92/189 |
| 6,413,230 | B1 | 7/2002 | Haupt et al. | |
| 6,416,499 | B2 | 7/2002 | Paul, Jr. | |

FOREIGN PATENT DOCUMENTS

DE 19725477 A1 12/1998

* cited by examiner

*Primary Examiner* — Tse Chen
*Assistant Examiner* — Joel F Brutus
(74) *Attorney, Agent, or Firm* — St. Onge Steward Johnston & Reens LLC

(57) ABSTRACT

An instrument for applying vibrations to the human body is disclosed, comprising a housing in which an axially movable ram is arranged at the distal end, and a drive device for the ram, for setting the ram in a reciprocating motion, wherein the drive device comprises an axially movable projectile arranged proximally of the ram and an accelerating device for the projectile for accelerating the projectile distally in the direction of the ram, the ram being able to execute a stroke of at least 1 mm.

19 Claims, 5 Drawing Sheets

INSTRUMENT FOR APPLYING VIBRATIONS TO THE HUMAN BODY

CROSS REFERENCE TO RELATED APPLICATION

The present application is a continuation-in-part of U.S. patent application Ser. No. 11/178,910 filed on Jul. 11, 2005 now abandoned, which claims priority of German utility model application 20 2004 011 323.6 filed on Jul. 9, 2004.

BACKGROUND OF THE INVENTION

The invention relates to an instrument for applying vibrations to the human body.

It is already known that mechanical vibrations can exert a therapeutic action. For example, muscle tension can be released by means of vibrations.

The vibration instruments or vibration appliances available at the present time have a vibration head which is actuated via an electromagnetic drive device. The electromagnetic drive normally comprises a motor and an oscillator coil. The oscillations of the vibration head in these known appliances are generally periodic, and the frequency of the vibration, because of the direct mains supply of the electromagnetic drive, is 50-60 Hz, with the result that the leading edge of the vibration stroke of the vibration head is approximately 2.5 ms. The action exerted on body tissue by the vibration head of conventional vibration appliances of this kind is such that, when the vibration head is placed on the skin, cellular processes can be activated in the underlying tissue by the vibrations generated by the vibration head. However, the known vibration appliances have the disadvantage that, because of the electromagnetic drive, the vibrations are relatively slow, which in some cases reduces the therapeutic effect. Moreover, because of the electromagnetic drive, the conventional vibration appliances are also relatively heavy and therefore difficult to handle.

Pressure-wave and/or shock-wave instruments and appliances for therapeutic purposes are also known, for example from the document DE-C-197 25 477.

In contrast to vibration appliances, pressure-wave appliances generate very hard pressure waves or shock waves which have a leading edge of ca. 2 μs and an amplitude of ca. 15 MPa (measured at a distance of 1 cm from the applicator). These pressure-wave instruments or appliances have, at the distal end, an axially movable ram whose axial stroke, however, is very small, for example a maximum of 0.2 mm. To generate a pressure wave or shock wave by means of the ram, a drive device is provided which comprises an axially movable projectile, arranged proximally of the ram, and an accelerating device for the projectile. The accelerating device usually operates pneumatically with compressed air at approximately 2-4 bar. By means of the impact of the projectile accelerated by the accelerating device and striking the proximal end of the ram, a pressure wave or shock wave builds up in the ram, which wave runs from proximal to distal through the ram and there leaves the ram as pressure wave or shock wave and can penetrate into the body tissue. The ram generally has a much greater mass than the projectile and is held relatively rigidly in the housing of the instrument handpiece. As has already been mentioned, the travel of the ram in such pressure-wave appliances is very small as a result of the impact.

The therapeutic action of pressure waves or shock waves is different than that of mechanical vibrations, so that pressure-wave instruments or appliances of this kind are used for treatment of other clinical symptoms, for example the treatment of calcifications of the tendon insertions and such like.

Document U.S. Pat. No. 4,549,535 discloses a massage instrument comprising a ram and, proximally of the ram, a piston which can be accelerated in the direction of the ram by means of an electromagnetic linear drive.

Document U.S. Pat. No. 4,716,890 describes an instrument for use in chiropractic treatment, having an axially movable ram which is provided with a rubber tip and whose stroke length can be adjusted in order to adapt the force exerted on the body. The ram is triggered by means of a pneumatic drive mechanism, with compressed air acting on a spring-pretensioned piston which is accelerated distally by the compressed air in order to move the ram in the distal direction. The ram itself is not pretensioned in its proximal position.

SUMMARY OF THE INVENTION

The object of the invention is to make available an instrument for applying vibrations to the human body, so as to activate cellular processes in the tissue with the vibrations from the instrument, said instrument being intended to be able to generate more rapid vibrations than conventional vibration appliances, and yet being compact and of light weight.

According to the invention, this object is achieved by an instrument for applying vibrations to the human body, with a housing in which an axially movable ram is arranged at the distal end, and with a drive device for the ram, for setting the ram in a reciprocating motion, wherein the drive device comprises an axially movable projectile arranged proximally of the ram, and an accelerating device for the projectile, for accelerating the projectile distally in the direction of the ram, and the ram being able to execute a stroke of at least 1 mm.

According to the invention, an instrument for applying vibrations to the human body is thus made available which corresponds to a pressure-wave appliance in respect of the drive device, but which differs from such an appliance in that the ram is able to execute a stroke of at least 1 mm. It is true that the impact of the projectile on the proximal end of the ram may still possibly create a pressure wave or shock wave in the ram with a very high frequency, but, in contrast to an appliance acting purely with pressure waves, the ram driven by the drive device can execute vibrations with a stroke of at least 1 mm, preferably of up to 3 mm or even higher, such that, when the ram is applied to the skin, the underlying tissue can be stimulated by the vibrations to activate cellular processes in the tissue. Compared to the conventional vibration appliances, the vibration appliance according to the invention has the advantage that it does not have an electromagnetic drive, and it can therefore be made more compact and of lighter weight. The additional advantage over conventional vibration appliances is that much more rapid vibrations can be generated by the drive mechanism with projectile provided in the instrument according to the invention, as a result of which the therapeutic action of the instrument according to the invention is improved compared to the conventional vibration instruments.

In a particularly preferred embodiment, the ram is biased, i.e. pretensioned in its rest position in the housing by means of at least one elastic element, from which rest position the ram can be propelled distally by the impact of the projectile.

An advantage of this is that, by means of the at least one elastic element, a structurally simpler and thus less expensive recovery mechanism is created for bringing the ram from the distally propelled position back to the proximal rest position.

The hardness of the elastic element determines, inter alia, the speed with which the ram moves from the proximal position to the distal position.

In particular, and advantageously, the elastic element can also assume the function of a guide element or resilient mounting for the ram, in particular if, according to a preferred embodiment, the at least one elastic element is configured in the form of a disk made of an elastomer, which disk is secured with its outer edge on the housing and is secured with its inner edge on the ram.

In addition, or alternatively, the ram, according to another preferred embodiment, can be guided in the housing in a slide bearing.

The provision of a slide bearing, as an addition to the aforementioned elastic disk, has the advantage that tilting of the ram away from the longitudinal axis, when impacted by the projectile, is more reliably avoided.

It is in this case further preferred if the slide bearing is made of a material comprising PEEK or PTFE.

An advantage of this is that the ram is guided in the slide bearing with particularly low friction, which means that frictional losses, and consequently a reduced vibration action of the ram, can be avoided or at least minimized. The wear and tear of the ram is also advantageously reduced.

In an alternative to the aforementioned embodiment with a slide bearing, the ram can be pretensioned in its rest position and guided in the housing by means of at least two elastic elements.

For example, instead of the slide bearing, a second disk made of elastomer can be provided in a position axially spaced apart from the first disk, as a result of which the spring action can be increased, if appropriate, compared to the case of just one elastic disk, and the second disk forms, together with the first disk, a parallel guide arrangement for the ram.

Various materials can be used as elastomers, preference being given to nitrile-butadiene rubber (NBR), a synthetic rubber. Nitrile-butadiene rubber has proven particularly effective as a material for the elastic disk because of its wear properties.

According to an embodiment of the invention, an instrument for applying vibrations to the human body is provided. The instrument comprises a housing which has a distal end. The instrument further comprises a ram arranged in the housing at the distal end in axially movable fashion. The ram is able to execute a stroke of at least 1 mm. The instrument further comprises a drive device for setting said ram in a reciprocating motion, wherein the drive device comprises an axially movable projectile arranged proximally of the ram and an accelerating device for the projectile for accelerating the projectile distally in direction to said ram. The ram is biased in its rest position in the housing by means of an elastic element, from which rest position the ram can be propelled distally by an impact of the projectile. The elastic element is configured as a bellows which at least partially surrounds the ram.

One of the advantages of this embodiment of the invention is that the ram's travel in distal direction is limited by the bellows, while the bellows has sufficient mechanical strength in order not to break when it is alternatingly compressed in distal direction and relaxed in proximal direction due to the reciprocating movements of the ram. Further, the bellows has the advantage in that it can seal off the ram in the housing in at least liquid-tight manner so that further seals can be dispensed with.

In a preferred embodiment, the bellows has a plurality of rounded folds, wherein said folds are reinforced by O-rings inserted in said folds.

The O-rings are preferably made of an elastomer. The O-rings advantageously reinforce the bellows. It could also be envisaged to reinforce the bellows by increasing the wall thickness of the bellows, but it has been found that the bellows tends to break when the wall thickness is too high.

In a further preferred embodiment, the bellows is made of plastics. The plastics and, thus, the bellows preferably is soft or resilient so as to be able to be compressible in axial direction.

Further, the bellows has a first proximal end resting against the ram and a second distal end resting against a part of the housing.

As already mentioned, the bellows preferably seals off the ram distally in the housing.

In a further preferred embodiment, the ram is made of titanium.

This measure has the advantage in that titanium is mechanically strong while being lower in weight than steel or stainless steel. The higher mechanical strength reduces the risk that the ram breaks when the projectile hits the ram in order to propel the ram in distal direction. Further, the lower weight of titanium results in a higher velocity of the ram when propelled distally which can improve the therapeutical effect of the ram when its vibrations are applied to the human body.

In a further preferred embodiment, the ram has a mass which is not substantially greater than the mass of the projectile; the mass of the ram should in particular be as low as possible.

One of the advantages of this measure is that the impulse transmission from the projectile to the ram is optimal with approximately identical masses, and, in addition, a low mass of the ram has the further advantage that a greater travel and speed of travel can be achieved than with a heavy ram.

The mass of the ram should preferably be greater than the mass of the projectile by a factor of at most 15, preferably of at most 10.

In a further preferred embodiment, a distal application surface of the ram has a diameter of at least 5 mm, preferably of at least 20 mm.

The distal application surface of the ram is the surface with which the ram touches the skin when the instrument is in use. A large application surface of the ram has the advantage that a greater tissue area can be treated by means of the vibrations generated by the ram, so as to provide an improved activation of the cellular processes in the tissue.

In a further preferred embodiment, a leading edge of the stroke of the ram from the proximal position to the distal position is less than 500 μs long, preferably less than 100 μs long.

The advantage of this measure is that the mechanical action of the ram on the skin, and thus on the underlying tissue, can be like a whiplash, in contrast to the conventional vibration appliances in which the vibrations are considerably slower. The therapeutic action is thus also improved by the greater impact of the ram of the instrument according to the invention. The therapeutic action of the instrument according to the invention can be classed between the conventional vibration appliances and the pressure-wave appliances; however, compared to the pressure-wave appliances, it is the mechanical action of the ram on the tissue that is the primary feature, not the high-frequency pressure wave or shock wave.

In a further preferred embodiment, the space between the ram and the projectile is airtight.

An advantage of this is that, in order to bring the projectile from the distal position to the proximal position, a recovery mechanism can be used which is based on the action of a pneumatic spring. The air enclosed between the ram and the projectile is in fact compressed as the projectile travels from the proximal position to the distal position. The return movement of the projectile from the distal position to the proximal position is thus effected by the impact of the ram and also by the pneumatic spring between the ram and the projectile.

In this connection, it is preferred if the elastic element, which pretensions the ram in its rest position, seals off the ram distally in the housing.

An advantage of this is that additional sealing measures can be dispensed with, because the elastic element additionally assumes the sealing function. In this way, further weight is saved and the production costs of the instrument according to the invention are reduced.

In a further preferred embodiment, the accelerating device acts pneumatically.

A pneumatic accelerating device has the advantage of having a very low weight; in addition, with a pneumatic accelerating device of the kind customarily used in pressure-wave appliances, it is possible to generate very short but very strong pressure impulses which can accelerate the projectile very efficiently to a high speed. A high speed of the projectile also leads advantageously to very rapid acceleration of the ram and thus, in the context of the therapeutic action, to a high impulse transmission from the ram to the tissue that is to be treated.

In a further preferred embodiment, a recovery mechanism for the projectile, for moving the projectile back in the proximal direction, is at least also based on the action of a pneumatic spring.

This measure has the advantage that no additional component such as a spring is needed for returning the projectile from the distal position to the proximal position, thus resulting in a further weight saving for the instrument.

In a further preferred embodiment, the housing has, at the distal end, an opening in which a distal head of the ram is exposed, and, on one edge of the head, there is a collar which extends at least about a partial circumference and acts as a distal stop for the ram.

An advantage of this is that, for example in the case of a ram breaking, the head of the ram, when impacted by the projectile, cannot shoot out of the housing, and this improves the operational safety of the instrument according to the invention.

In a further preferred embodiment, the ram has a ram construction which avoids material breaks, in particular with the outer and inner edges of the ram being rounded.

The advantage of this measure is that the operational safety of the instrument and in particular also the ease of maintenance of the instrument are improved.

In a further preferred embodiment, the housing with the ram is designed as an instrument attachment for detachable connection to the drive device.

A particular advantage of this is that the instrument attachment, consisting of the housing and of the ram contained therein, can be fitted onto the drive device of an already existing pressure-wave appliance if the already existing pressure-wave appliance is likewise equipped with a detachable application part. In this way, the functionality of an already existing pressure-wave appliance can be improved in a particularly cost-effective manner.

Accordingly, the invention also relates to an instrument attachment, with a housing in which an axially movable ram is arranged at the distal end, for an instrument for applying mechanical vibrations to the human body in accordance with one of the preceding embodiments.

Such an instrument attachment can then advantageously be connected in a detachable manner to a drive device of a pressure-wave appliance.

In the instrument according to the invention, provision is also advantageously and preferably made for the instrument attachment to be able to be dismantled into its individual parts, i.e. into the housing, the ram and, if appropriate, the elastic element and, if appropriate, the slide bearing, as a result of which the instrument attachment is very easy to clean, and the hygiene features of the instrument attachment are improved.

Further advantages and features will become evident from the following description of the attached drawing.

It will be appreciated that the features mentioned above and the features still to be discussed below can be used not only in the respectively cited combination, but also in other combinations or singly, without departing from the scope of the present invention.

BRIEF DESCRIPTION OF THE DRAWINGS

Illustrative embodiments of the invention are shown in the drawing and is described in more detail below with reference to said drawing, in which.

DETAILED DESCRIPTION OF PREFERRED EMBODIMENTS

Figure 1:
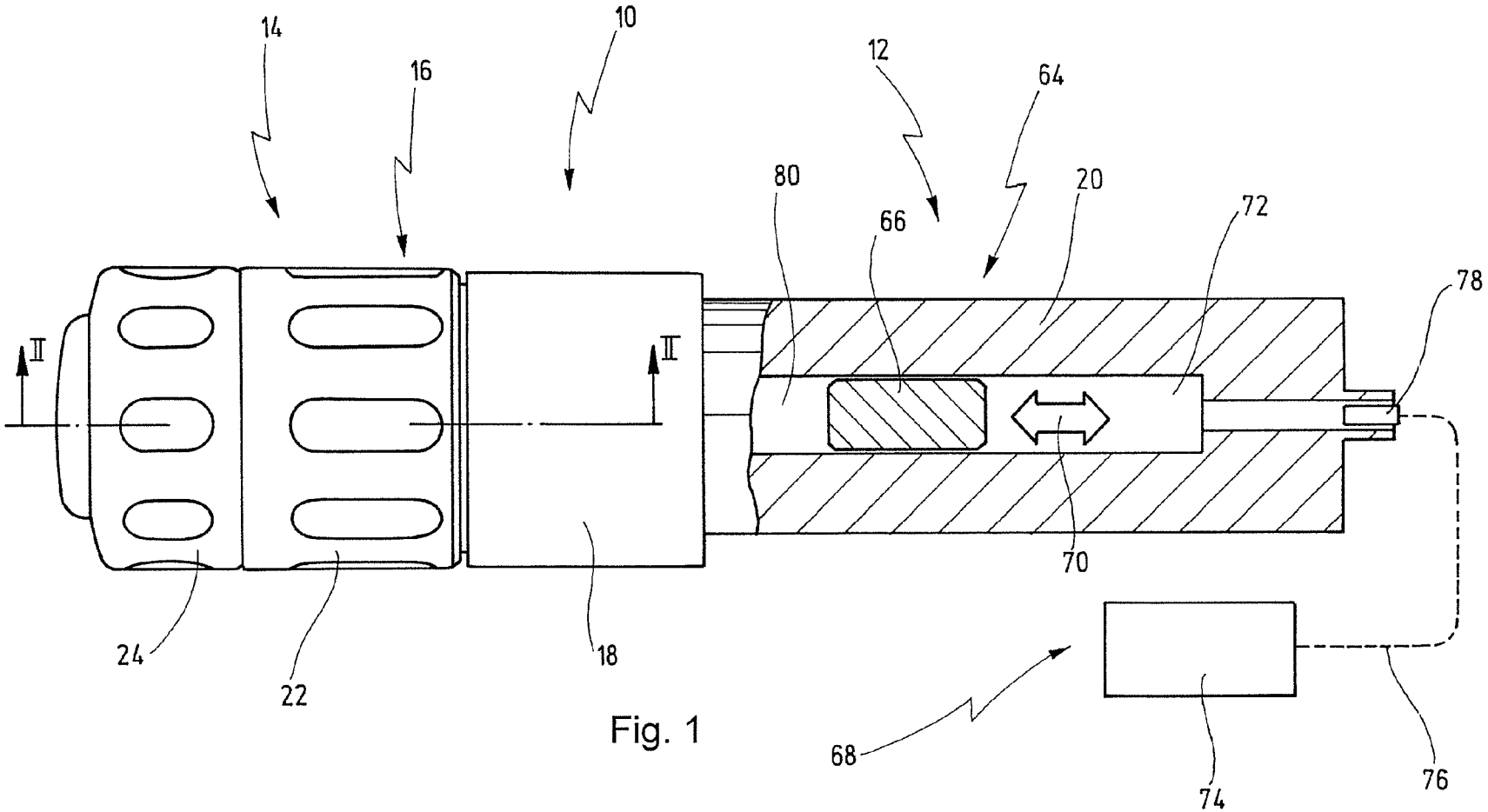
FIG. 1 shows an instrument for applying vibrations to the human body in a side view, partially cut away and in longitudinal section.

In FIG. 1, an instrument for applying vibrations to the human body is indicated by general reference number 10.

The instrument 10 has a handgrip 12 in the proximal area, and it has an instrument attachment 14 in the distal area, said instrument attachment 14 forming the actual vibration applicator of the instrument 10.

Figure 2:
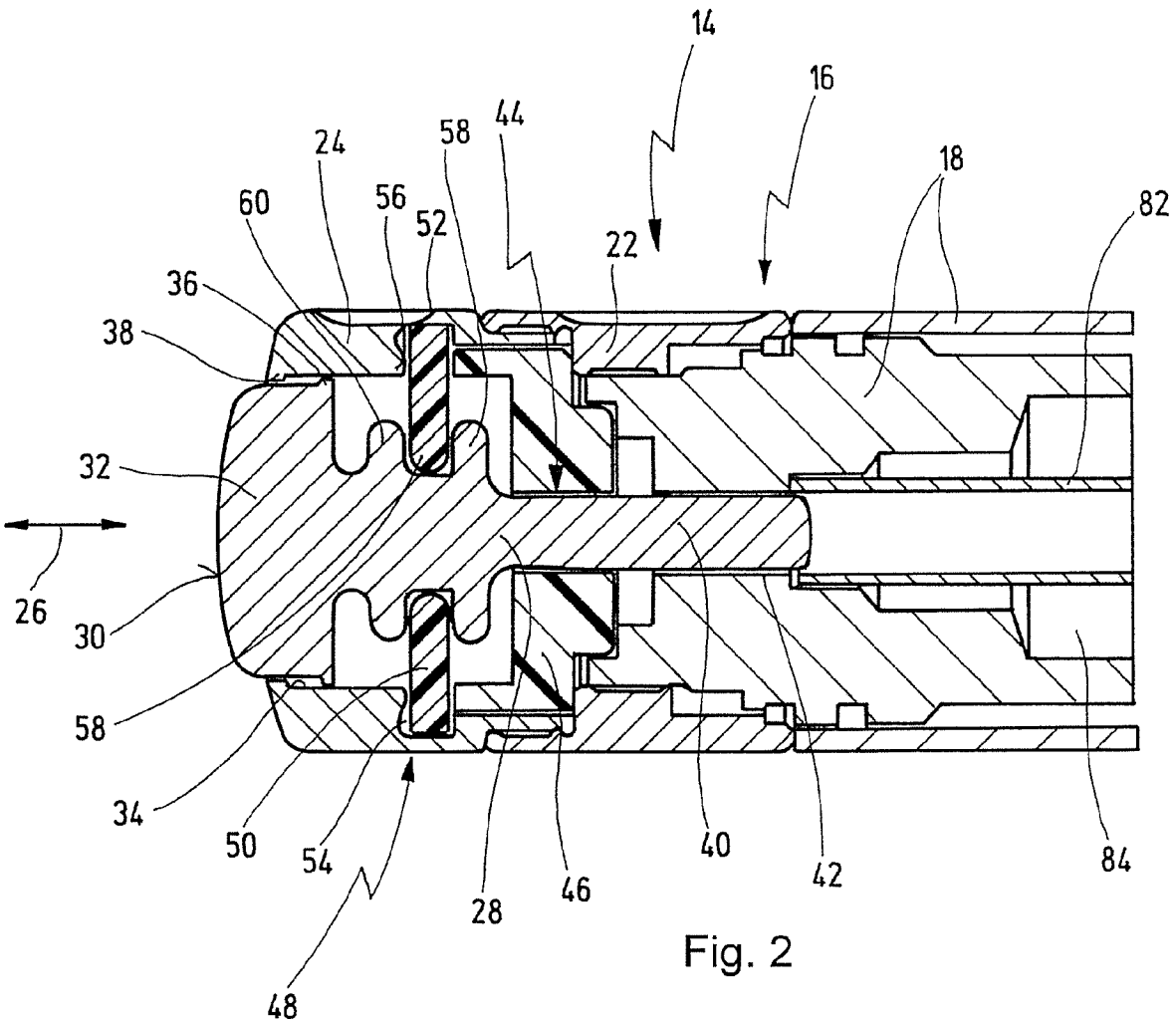
FIG. 2 shows a longitudinal section through an instrument attachment of the instrument in FIG. 1, in the section along line II-II in FIG. 1.

The instrument attachment 14 is shown in more detail in FIG. 2.

The instrument attachment 14 has a housing 16 which, in the present illustrative embodiment, is designed in several parts. A proximal housing part 18 is used for detachable connection of the instrument attachment 14 to a housing 20 of the handgrip 12.

The housing 16 also has two sleeves 22 and 24, the sleeve 22 being screwed onto the housing part 18, and the sleeve 24 being screwed onto the sleeve 22. The sleeves 22 and 24 are thus detachable.

A ram 28 which is axially movable, i.e. movable in the direction of a double arrow 26, is arranged in the housing 16 at the distal end thereof. The ram 28 serves to activate cellular processes in the tissue by means of vibrations.

The ram 28 has a distal application surface 30 which protrudes distally from the housing 16. In the illustrative embodiment shown, the application surface 30 has a convex curvature, but it can also be flat or have a concave curvature.

The application surface 30 of the ram 28 is formed on a head 32 of the ram 28 lying exposed in a distal opening 34 in the housing 16. At the proximal end of the head 32 there is a radially outwardly directed collar 36 which extends about a complete circumference and which, in cooperation with a radially inwardly directed collar 38 formed on the opening 34 of the housing 16 and extending about a complete circumference, ensures that, in the case of the ram 28 breaking, the head 32 cannot escape from the opening 34.

At its proximal end, the ram 28 has a shaft 40 which is of a smaller diameter than the head 32 and which is arranged partially in a bore 42 in the housing part 18, but without touching the wall of the bore 42.

The ram 28 is guided at its shaft 40 by a slide bearing 44 which, in the present illustrative embodiment, is formed by a bushing-like disk 46 made of PEEK or PTFE. Instead of a disk made of PEEK or PTFE, which are distinguished by a smooth surface, such that the ram 28 is mounted in the housing 16 with particularly low friction, it is also possible to use a slide bushing.

The disk 46 is held in an axially immovable manner in the housing between the sleeve 24 and the sleeve 22.

The ram 28 is also pretensioned or biased in its rest position in the housing 16 by means of at least one elastic element 48, from which rest position, shown in FIG. 2, the ram 28 can be propelled distally, in a manner which will be described below. The elastic element 48 is configured in the form of a disk 50 made of an elastomer, which disk 50 is secured with its outer edge 52 on the housing 16, specifically, in the illustrative embodiment shown, in a pocket 54 of the distal sleeve 24. As will be seen from FIG. 2, the pocket 54 has an axially directed undercut, or an axially rearwardly offset and rounded annular shoulder 56, such that the disk 50, in the pocket 54, bears substantially only on the shoulder 56 in the axial direction.

The elastomer used for the disk 50 can, for example, be silicone rubber or, preferably, nitrile-butadiene rubber (NBR), since this material is durable and can therefore withstand a very high number of load alternations caused by the reciprocating motion of the ram 28.

An inner edge 58 of the disk 50 is secured on the ram 28, the edge 58 engaging between two axially spaced apart annular flanges 58 and 60 of the ram 28 which are formed between the proximal shaft 40 and the distal head 32. As will be seen from FIG. 2, the annular flanges 58 and 60 have a rounded configuration, as do all the other edges of the ram 28, in particular the inner edges between the flanges 58 and 60, between which the inner edge 58 of the disk 50 engages. The rounded configurations prevent notch effects on the ram 28.

The ram 28, the slide bearing 44 and the disk 46 can be removed from the housing 16, i.e. the instrument attachment 14 can be completely dismantled into its above-described parts.

The instrument 10 also has a drive device 64 for setting the ram 28 in a reciprocating motion. According to FIG. 1, which is only schematic in respect of the drive device 64, said drive device 64 comprises an axially movable projectile 66 arranged proximally of the ram 28, and an accelerating device 68 for the projectile 66.

The projectile 66 is arranged axially, in accordance with double arrow 70, in a bore 72 in the housing 20 of the handgrip 12.

The accelerating device 68 comprises a compressed air source 74 which is or can be connected, via a line 76, to a compressed air inlet, preferably a valve or connector 78 at the proximal end of the handgrip 12.

The accelerating device 68 is therefore a pneumatically operating accelerating device which, by means of compressed air impulses, accelerates the projectile 66 in the direction of the ram 28. Each compressed air impulse brings about a stroke of the projectile 66 to the ram 28, where the projectile 66 impacts the proximal end of the shaft 40 of the ram 28 and propels it distally from the position shown in FIG. 2. Arranged in the instrument attachment 14, proximally of the ram 28, there is a guide tube 82 in which the projectile 66 is guided.

To move the projectile 66 back to its proximal starting position, a recovery mechanism for the projectile 66 is provided which is based on a pneumatic spring 80 formed by air in the space between the projectile 66 and the proximal end of the ram 28, the guide tube 82 being surrounded by a dynamic pressure chamber 84 in which the air is compressed when the projectile 66 moves in the distal direction.

It will be appreciated that the projectile 66 is guided in the bore 72 in an airtight manner, and that, proximally of the projectile 66, a venting means (not shown) must be provided for the space proximal of the projectile 66.

The space between the projectile 66 and the ram 28 is sealed distally by the disk 50, which at the same time forms the recovery mechanism for the ram 28, as has already been described above.

The ram 28 is held in the housing 16 in such a way that it can execute a stroke of at least 1 mm when the projectile 66 impacts the ram 28.

In the most favorable case, the mass of the ram 28 is of the order of magnitude of the mass of the projectile 66; however, the mass of the ram 28 ought to be greater than the mass of the projectile 66 by a factor of at most 15, preferably at most 10.

The distal application surface 30 of the ram 28 has a diameter of at least 5 mm, preferably at least 20 mm.

A leading edge of the stroke of the ram 28 from the proximal position shown in FIG. 2 to its maximum distal position is less than 500 μs long, preferably less than 100 μs long. In this way, the ram 28 moves very quickly from its proximal position to its distal position, as a result of which the impulse transmission from the ram 28 to the skin and to the underlying tissue during treatment is particularly effective, and the desired activation of cellular processes is promoted.

The drive mechanism 64 for the ram 28, with a projectile 66 and a pneumatic accelerating device 68, has the advantage that the ram 28 can be driven in very rapid vibrations.

The ram 28 itself is preferably made of a hard material, for example of steel, high-grade steel, preferably hardened, or of hard plastic. In any case, the ram 28 should be made of a material with a high degree of resistance to breaking, because the ram 28 is exposed to considerable loading caused by the repeated impact of the projectile 66.

As has already been mentioned, the instrument attachment 14, which includes the housing 16 and the ram 28, is designed to be detachable from the handgrip 12. The handgrip 12, which contains the drive device 64, can for example be one of the kind also used in conventional pressure-wave or shock-wave appliances.

Figure 3:
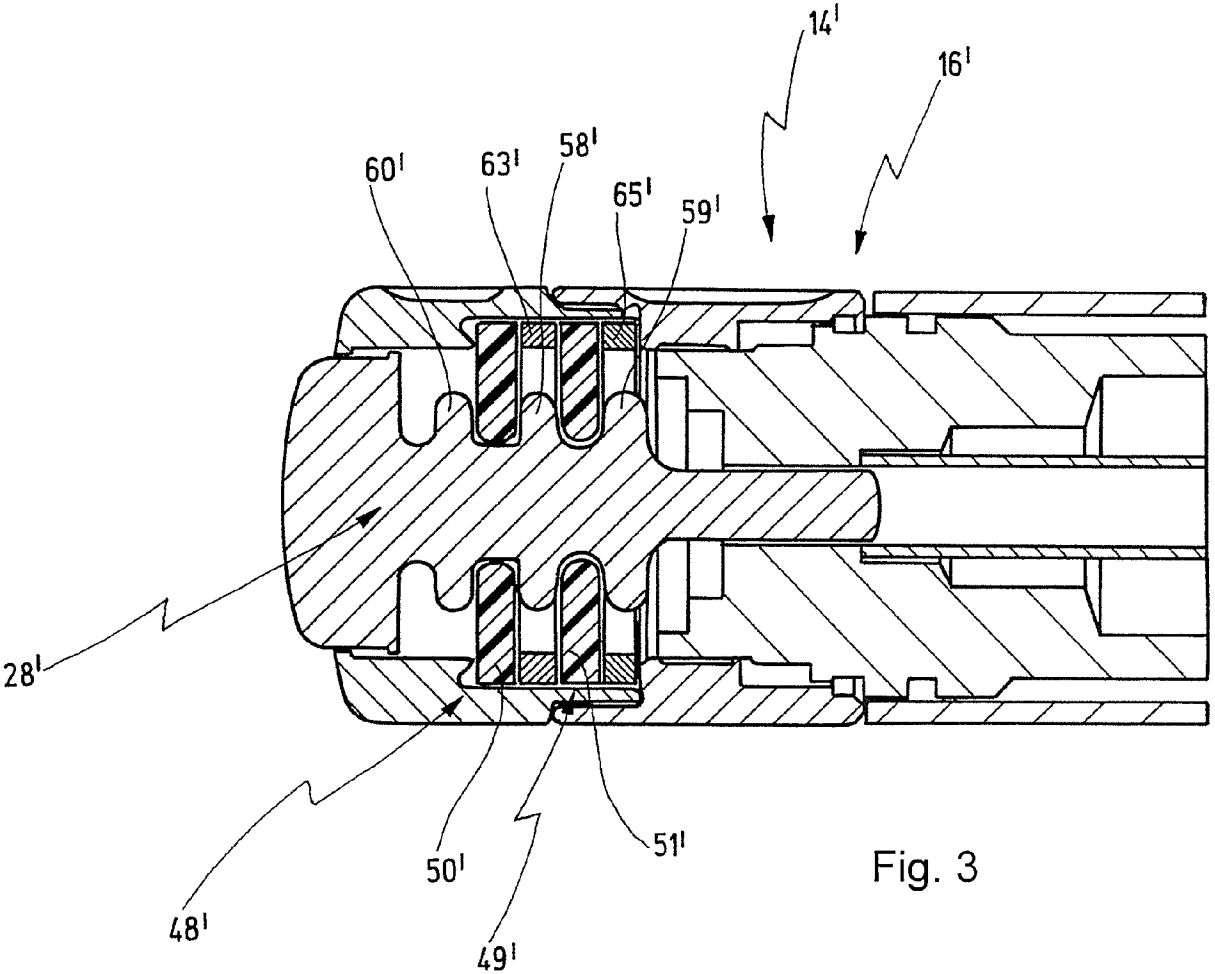
FIG. 3 shows a longitudinal section through an instrument attachment according to an illustrative embodiment which is modified slightly from the one in FIG. 2.

FIG. 3 shows an illustrative embodiment of an instrument attachment 14' modified slightly from the one in FIG. 2; parts which are comparable to the instrument attachment 14 are provided with the same reference numbers supplemented by a prime mark. Only the differences from the instrument attachment 14 are described below.

Instead of the slide bearing 44 of the instrument attachment 14, a second elastic element 49' is provided next to the elastic element 48', said elastic element 49' being designed as a second disk 51' additional to the disk 50'. The disks 50' and 51' not only pretension the ram 28' in its rest position, they also guide it in the manner of a parallel guide during its axial reciprocating movements. The second disk 51' is in engagement with the ram 28' between two annular flanges 58' and 59', as is, correspondingly, the disk 50' between the annular flanges 60' and 58'.

Arranged between the disks 50' and 51', which are both made of an elastomer, there is a spacer ring 63' which holds the outer edges of the disks 50' and 51' at a distance. The arrangement consisting of disks 50', 51' and spacer ring 63' is secured in the housing 16' by means of a clamping ring 65'.

In other respects, the configuration of the instrument attachment 14' corresponds to the configuration of the instrument attachment 14 in FIG. 2.

Figure 4:
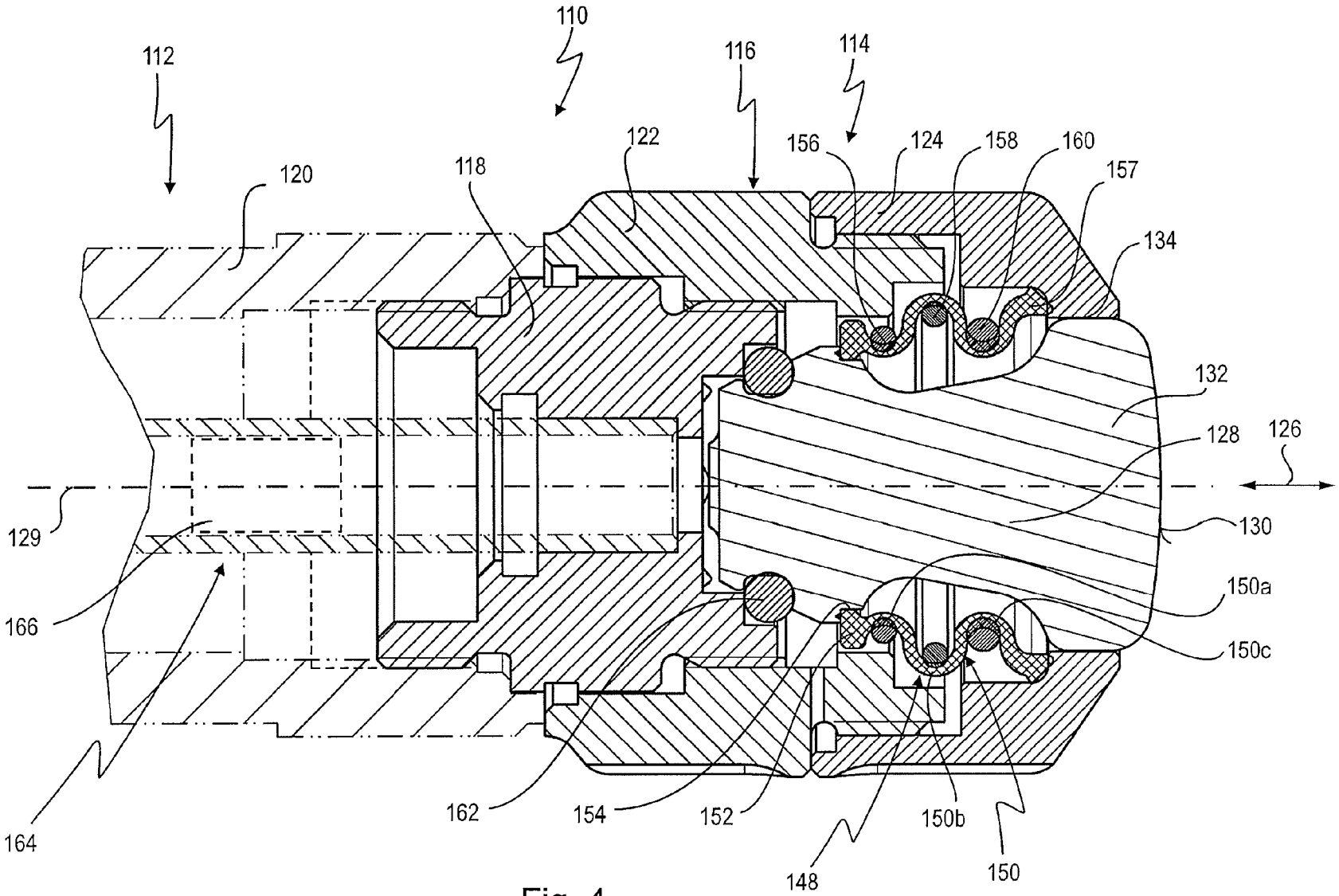
FIG. 4 shows a longitudinal section through another embodiment of an instrument for applying vibrations to the human body in a side view, wherein only a portion of a handgrip of the instrument is shown.

FIG. 4 shows another embodiment of an instrument for applying vibrations to the human body which is labeled by general reference number 110.

The instrument 110 has a handgrip 112 in the proximal area, wherein the handgrip 112 is only partially shown in FIG. 4. The instrument further has an instrument attachment 114 in the distal area, said instrument attachment 114 forming the actual vibration applicator of the instrument 110.

The instrument attachment 114 has a housing 116 which, in the present illustrative embodiment, is designed in several parts.

The housing 116 has two housing parts in form of sleeves 122 and 124, wherein the sleeve 122 is screwed onto an inner handgrip part 118 of the handgrip, and the sleeve 124 is screwed onto the sleeve 122.

All housing parts 122, and 124 are, thus, detachable by screwing. The housing 116, thus, can be detached from the handgrip 12 by detaching sleeve 122 from the handgrip part 118.

In the housing 116, there is arranged a ram 128, which is movable in direction of a longitudinal axis 129 of the instrument according to a double arrow 126. The ram 128 serves to activate cellular processes in the tissue by means of vibrations.

The ram 128 has a distal application surface 130 which protrudes distally from the housing 116. The application surface 130 has a diameter of 20 mm in this embodiment.

The ram 128 is made of titanium in this embodiment and has a low weight.

The application surface 130 of the ram 128 is formed on a head 132 of the ram 128 lying exposed in a distal opening 134 of the sleeve 124.

The ram 128 is pretensioned or biased in its rest position shown in FIG. 4 in the housing 116 by means of an elastic element 148, from which rest position the ram 128 can be propelled distally, in a manner which will be described below.

The elastic element 148 is configured as a bellows 150 made of plastics. The bellows 150 can be made of polytetrafluorethylene (PTFE), for example.

The bellows 150 has a plurality of folds 150*a*, 150*b*, 150*c* which are rounded and, when seen from the longitudinal axis 129, have a convex and concave shape in alternating fashion.

A proximal end 152 of the bellows rests against the ram 128 which, to this end, has a recess of substantially rectangular shape in which the proximal end 152 of the bellows 150 is partially received.

A distal end 157 of the bellows 150 rests against the sleeve 124 of the housing 116.

The bellows 150 partially surrounds the ram 128. Due to the folds 150*a*, 150*b*, 150*c* of the bellows 150, the bellows 150 can be compressed in axial direction when the ram 128 is propelled in distal direction, and can relax into its rest state shown in FIG. 4 thereby pushing the ram 128 in proximal direction.

In each fold 150*a*, 150*b*, 150*c* is arranged an O-ring, i.e. an O-ring 156 is arranged in the fold 150*a*, an O-ring 158 is arranged in the fold 150*b*, and an O-ring 160 is arranged in the fold 150*c*. The O-rings 156, 158, and 160 reinforce the bellows 150 and are made of stainless steel, for example, or of a plastic or elastomer.

The bellows 150 not only has the function to pretension or bias the ram 128 in its rest position, but also to seal off the ram 128 in a liquid or gas-tight manner against the interior of the housing 116.

There is another O-ring 162 surrounding the ram 128 which rests against the inner housing part 118 and which defines the rest position of the ram 128 in its most proximal position, from which the ram 128 can be propelled in distal direction.

The instrument 110 also has a drive device 164 for setting the ram 128 in reciprocating motion. The drive device 164 comprises an axially movable projectile 166, and an accelerating device for the projectile 166, which is identical with the accelerating device 68 for the projectile 66 in FIG. 1. Thus, for the description of the drive device 164, reference is made to the description of the drive device 64 in FIG. 1.

Figure 5:
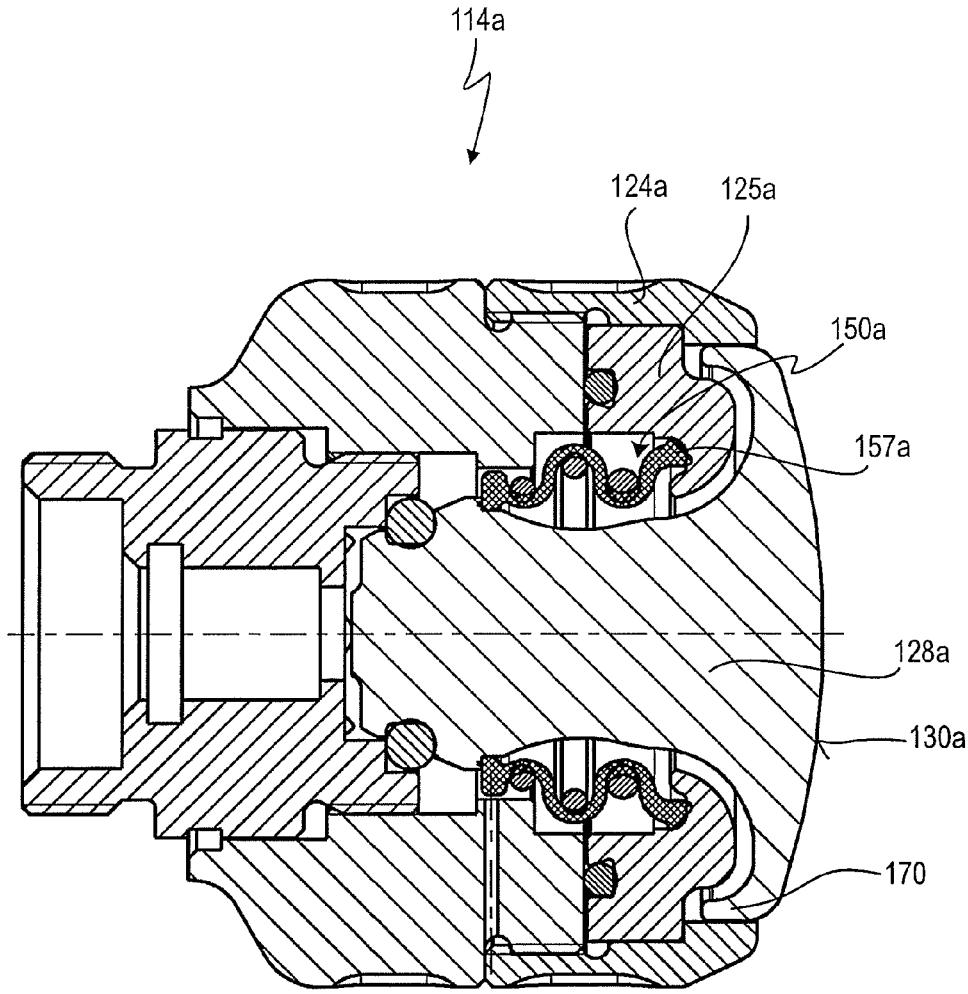
FIG. 5 shows a modification of an instrument attachment of the instrument in FIG. 4 in the longitudinal section.

FIG. 5 shows a modification of the instrument attachment 114 in FIG. 4, which differs from the application attachment 114 in FIG. 4 in that it has a ram 128*a*, an application surface 130*a* of which has an increased diameter of about 35 mm.

Further, inside a sleeve 124*a*, there is arranged another sleeve 125*a*, against which a bellows 150*a* rests with its distal end 157*a*.

The applicator 128*a* has a radial extension 170 which is arranged in a space between the sleeve 124*a* and the further sleeve 125*a*, as shown in FIG. 5.

The remaining features of the application attachment 114*a* and its function is identical with the features and the function of the application attachment 114.

What is claimed is:

1. An instrument for applying vibrations to the human body, comprising:

a housing having a distal end, a ram arranged in said housing at said distal end in axially movable fashion, said ram being able to execute a stroke of at least 1 mm, and a drive device for setting said ram in a reciprocating motion, said drive device comprising an axially movable projectile arranged proximally of said ram and an accelerating device for said projectile for accelerating said projectile distally in direction to said ram, wherein said ram is biased in its rest position in said housing by an elastic element, from which rest position said ram can be propelled distally by an impact of said projectile, wherein said elastic element is configured as a bellows at least partially surrounding said ram, and wherein said bellows has a plurality of rounded folds, wherein said folds are reinforced by O-rings inserted in said folds.

2. The instrument of claim 1, wherein said bellows is made of plastics.

3. The instrument of claim 1, wherein said bellows has a first proximal end resting against said ram and a second distal end resting against a part of said housing.

4. The instrument of claim 1, wherein said bellows seals off said ram distally in said housing.

5. The instrument of claim 1, wherein said ram is made of titanium.

6. The instrument of claim 1, wherein said ram has a mass which is not substantially greater than a mass of said projectile.

7. The instrument of claim 6, wherein said mass of said ram is greater than said mass of said projectile by a factor of at most 15.

8. The instrument of claim 6, wherein said mass of said ram is greater than said mass of said projectile by a factor of at most 10.

9. The instrument of claim 1, wherein a distal application surface of said ram has a diameter of at least 5 mm.

10. The instrument of claim 1, wherein a distal application surface of said ram has a diameter of at least 20 mm.

11. The instrument of claim 1, wherein a leading edge of said stroke of said ram from a proximal position to a distal position of said ram is less than 500 μs long.

12. The instrument of claim 1, wherein a leading edge of said stroke of said ram from a proximal position to a distal position of said ram is less than 100 μs long.

13. The instrument of claim 1, wherein a space between said ram and said projectile is airtight.

14. The instrument of claim 1, wherein said accelerating device acts pneumatically.

15. The instrument of claim 1, wherein a recovery mechanism for said projectile for moving said projectile back in the proximal direction is at least based on the action of a pneumatic spring.

16. The instrument of anyone of claim 1, wherein said housing has, at said distal end, an opening in which a distal head of said ram is exposed, and, on one edge of said head, there is a collar which extends at least about a partial circumference and acts as a distal stop for said ram.

17. The instrument of claim 1, wherein said housing with said ram is designed as an instrument attachment for detachable connection to said drive device.

18. The instrument of claim 1, wherein said ram has a ram construction which avoids material breaks, wherein outer and inner edges of said ram being rounded.

19. An instrument attachment for an instrument for applying vibrations to the human body, comprising a housing having a distal end, and a ram arranged in said housing in axially movable fashion at said distal end of said housing, said ram being able to execute a stroke of at least 1 mm, wherein said ram is biased in its rest position in said housing by an elastic element, wherein said elastic element is configured as a bellows at least partially surrounding said ram, and wherein said bellows has a plurality of rounded folds, wherein said folds are reinforced by O-rings inserted in said folds.

* * * * *